US007969392B2

(12) United States Patent
Yamashita et al.

(10) Patent No.: US 7,969,392 B2
(45) Date of Patent: Jun. 28, 2011

(54) CURRENT PROGRAMMING APPARATUS AND MATRIX TYPE DISPLAY APPARATUS

(75) Inventors: Takanori Yamashita, Kawasaki (JP); Masami Iseki, Yokohama (JP); Fujio Kawano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1499 days.

(21) Appl. No.: 11/283,862

(22) Filed: Nov. 22, 2005

(65) Prior Publication Data

US 2006/0114195 A1 Jun. 1, 2006

(30) Foreign Application Priority Data

Nov. 26, 2004 (JP) ..... 2004-342129

(51) Int. Cl.
*G09G 3/30* (2006.01)
*G09G 3/10* (2006.01)

(52) U.S. Cl. ..... 345/77; 315/169.3

(58) Field of Classification Search ..... 345/76–83; 313/463; 315/169.3
See application file for complete search history.

(56) References Cited

U.S. PATENT DOCUMENTS

| | | | | |
|---|---|---|---|---|
| 6,873,117 | B2 * | 3/2005 | Ishizuka | 315/169.1 |
| 6,975,290 | B2 | 12/2005 | Asano | 345/76 |
| 7,074,270 | B2 | 7/2006 | Sato et al. | 117/3 |
| 7,425,939 | B2 | 9/2008 | Asano | 345/76 |
| 2002/0195964 | A1 * | 12/2002 | Yumoto | 315/169.3 |
| 2003/0001828 | A1 | 1/2003 | Asano | 345/204 |
| 2003/0043131 | A1 | 3/2003 | Iguchi | 345/204 |
| 2004/0108998 | A1 | 6/2004 | Imamura | 345/204 |
| 2004/0183752 | A1 | 9/2004 | Kawasaki et al. | 345/20 |
| 2005/0007359 | A1 | 1/2005 | Iseki et al. | 345/204 |

(Continued)

FOREIGN PATENT DOCUMENTS

| | | |
|---|---|---|
| JP | 2003-050564 | 2/2003 |

(Continued)

OTHER PUBLICATIONS

U.S. Appl. No. 11/539,442, filed Oct. 6, 2006, Takanori Yamashita, et al.

*Primary Examiner* — Bipin Shalwala
*Assistant Examiner* — Keith Crawley
(74) *Attorney, Agent, or Firm* — Fitzpatrick, Cella, Harper & Scinto

(57) ABSTRACT

A matrix type display apparatus includes a pixel circuit unit including electroluminescent elements and pixel circuits driving the electroluminescent elements arranged in a matrix, a plurality of data lines, each corresponding to a column of the pixel circuits for supplying a data current to the pixel circuits, and predetermined current setting circuits for supplying to the data lines a predetermined current for reducing a current to be supplied to the data lines, according to a setting by a reference current unrelated to a displaying, at a time of black displaying of the electroluminescent elements. In addition, switches are arranged corresponding to each of the data lines between the pixel circuits and the predetermined current setting circuits, and a row scanning circuit controls on and off of the switches. The row scanning circuit turns off the switches to disconnect the pixel circuit unit and the predetermined current setting circuits, and sets the predetermined current in the predetermined current setting circuits, and thereafter, the row scanning circuit turns on the switches to connect the pixel circuit unit and the predetermined current setting circuits, and to supply the data lines with the data current and the predetermined current.

3 Claims, 5 Drawing Sheets

U.S. PATENT DOCUMENTS

| | | | | |
|---|---|---|---|---|
| 2005/0054197 | A1 | 3/2005 | Sato et al. | 438/689 |
| 2005/0122150 | A1 | 6/2005 | Iseki et al. | 327/215 |
| 2006/0114194 | A1 | 6/2006 | Kawasaki et al. | 345/76 |
| 2006/0132395 | A1 | 6/2006 | Kawasaki et al. | 345/75.2 |

FOREIGN PATENT DOCUMENTS

| | | |
|---|---|---|
| JP | 2003-076327 | 3/2003 |
| JP | 2004-004789 | 1/2004 |
| JP | 2004-312015 | 11/2004 |

* cited by examiner

CURRENT PROGRAMMING APPARATUS AND MATRIX TYPE DISPLAY APPARATUS

BACKGROUND OF THE INVENTION

1. Field of the Invention

The present invention generally relates to a current programming apparatus, a matrix type display apparatus, a current programming method, and a drive method of a matrix type display apparatus, and more particularly to ones suitably used for an active matrix type display apparatus using current based driven display elements.

2. Description of Related Art

In an active matrix type display apparatus using electroluminescent elements, a current writing type circuit writing a drive current of a light emitting device into the drive circuit of each pixel to make the drive circuit store the drive current has been used. In the present specification, such an operation of writing a drive current into each pixel of a matrix type display apparatus to make the drive circuit store the drive current is called as current programming, and the circuit for the current programming is called a current programming circuit.

In FIG. 18 of United States Patent Published Application No. 2002/0195964, a current programming circuit holding a current flowing in a data line as a gate-source voltage of a transistor is disclosed. Moreover, in the document, it is mentioned that gradation displays of black and low luminance levels can be improved by flowing the current into the direction of cancelling a writing current at the time of writing data into the current programming circuit.

When a conventional current writing type pixel circuit is used, there is a case where an operation of writing an image data current cannot be stably performed in each pixel circuit. The details of the case are described in the following, but the cause of the case is the dispersion of the threshold value of the drive transistor of each pixel.

SUMMARY OF THE INVENTION

It is an object of the present invention to provide a current programming apparatus, an active matrix type display apparatus, and a current programming method of these apparatus, all making it possible to perform the writing operation of the image data current mentioned above stably.

A current programming apparatus of the present invention is a current programming apparatus including:

a current source;

a plurality of first circuits commonly connected with a data line, each receiving supply of a data current through the data line;

a second circuit having a terminal connected to the current source; and a switch electrically connecting or breaking the terminal of the second circuit with or from the data line, wherein the current source generates a predetermined current and supplies the generated current to the second circuit through the terminal while the switch is off, whereby a value of the predetermined current is written in the second circuit; and the current source generates a current based on data, and the second circuit generates a current based on the written value of the predetermined current, and a difference current between the current generated by the current source and the current generated by the second circuit is supplied to one of the first circuits through the data line while the switch is on, whereby a value of the difference current is written in the first circuit as a value of the data currents.

A matrix type display apparatus of the present invention is a matrix type display apparatus including:

a current source;

a plurality of display elements arranged in a matrix to be current based driven;

a plurality of pixel circuits each provided to each of the display elements, the pixel circuits commonly connected in column directions with data lines to receive supply of data currents through the data lines;

predetermined current setting circuits having a terminal connected to the current source; and switches each electrically connecting or breaking the terminal with or from each of the data lines, wherein the current source generates predetermined currents to supply the generated currents to the predetermined current setting circuits through the terminal while the switches are off, whereby a value of the predetermined currents are written in the predetermined current setting circuits; and the current source generates a current based on data, and one of the predetermined current setting circuits generates a current based on the written values of the written predetermined currents, and difference currents of the currents generated by the current source and the currents generated by the predetermined current setting circuits are provided to the pixel circuits, whereby values of the difference currents are written into the pixel circuits as values of the currents based on the data.

A current programming method of the present invention is a current programming method including:

a first step of supplying a data current to each of a plurality of first circuits connected to a data line commonly through the data line to write a value of the data current into the first circuits; and a second step of supplying a predetermined current to a second circuit to write a value of the predetermined current into the second circuit, wherein the second step includes a step of breaking the second circuit from the data line electrically and a step of making a current source generate a predetermined current to supply the generated current to the second circuit, and the first step includes a step of connecting the second circuit with the data line electrically, a step of making the current source generate a current based on data, a step of making the second circuit generate a current based on the value of the predetermined current written at the second step, and a step of supplying a difference current of the current generated by the current source and the current generated by the second circuit to one of the first circuits through the data line.

A drive apparatus for driving electro-optic elements of the present invention includes:

a matrix circuit unit (1) in which circuits (110, 120) for generating drive currents to be supplied to the electro-optic elements (EL) are arranged in a matrix;

a current source (4) for supplying a writing current (Idata1) to each of the circuits through one of a plurality of data lines;

a current setting circuit (130) for flowing a compensation current (Iz) in a direction of cancelling the writing current in each of the data lines, the current setting circuit provided to each of the data lines; and switches connecting or breaking the current setting circuits with or from the data lines corresponding to the current setting circuits electrically, wherein currents for generating the compensation currents (currents for setting the compensation currents) are supplied from the current source to the current setting circuits in a state in which the current setting circuits and the data lines corresponding to the current setting circuits are electrically broken.

Moreover, an active matrix display apparatus of the present invention includes:

a pixel circuit unit (1) in which electro-optic elements (EL) luminance of which changes according to flowing currents and pixel circuits (110, 120) for generating drive currents to be supplied to the electro-optic elements are arranged in a matrix;

a current source for supplying a writing current (Idata1) to each of the pixel circuits through a plurality of data lines;

a current setting circuit (130) provided to each of said data lines for flowing a compensation current in each data line into a direction of cancelling the writing current; and a switch (M5) connecting or breaking the current setting circuit with or from a data line corresponding to the current setting circuit electrically, wherein a current for generating the compensation current (a current for setting the compensation current) is supplied from the current source to the current source setting circuit in a state in which the current setting circuit and the data line corresponding to the current setting circuit is broken by the switch.

It is preferable that the current source setting circuit includes a holding capacitor (C1) holding a voltage obtained by converting the current supplied from the current source, and a transistor (M1) for supplying a current according to the voltage held by the holding capacitor to the data line as the compensation current.

In the present invention, a current (Idata2) having a magnitude obtained by subtracting the compensation current (Iz) from the writing current (Idata1) supplied from the current source is supplied to the pixel circuits.

According to the present invention, the influences of the parasitic capacitance of a data line can be suppressed, and the writing operation of current can be stabilized.

DETAILED DESCRIPTION OF THE PREFERRED EMBODIMENTS

In the following, the preferred embodiments of the present invention are described in detail with reference to the attached drawings.

First Embodiment

Figure 3:
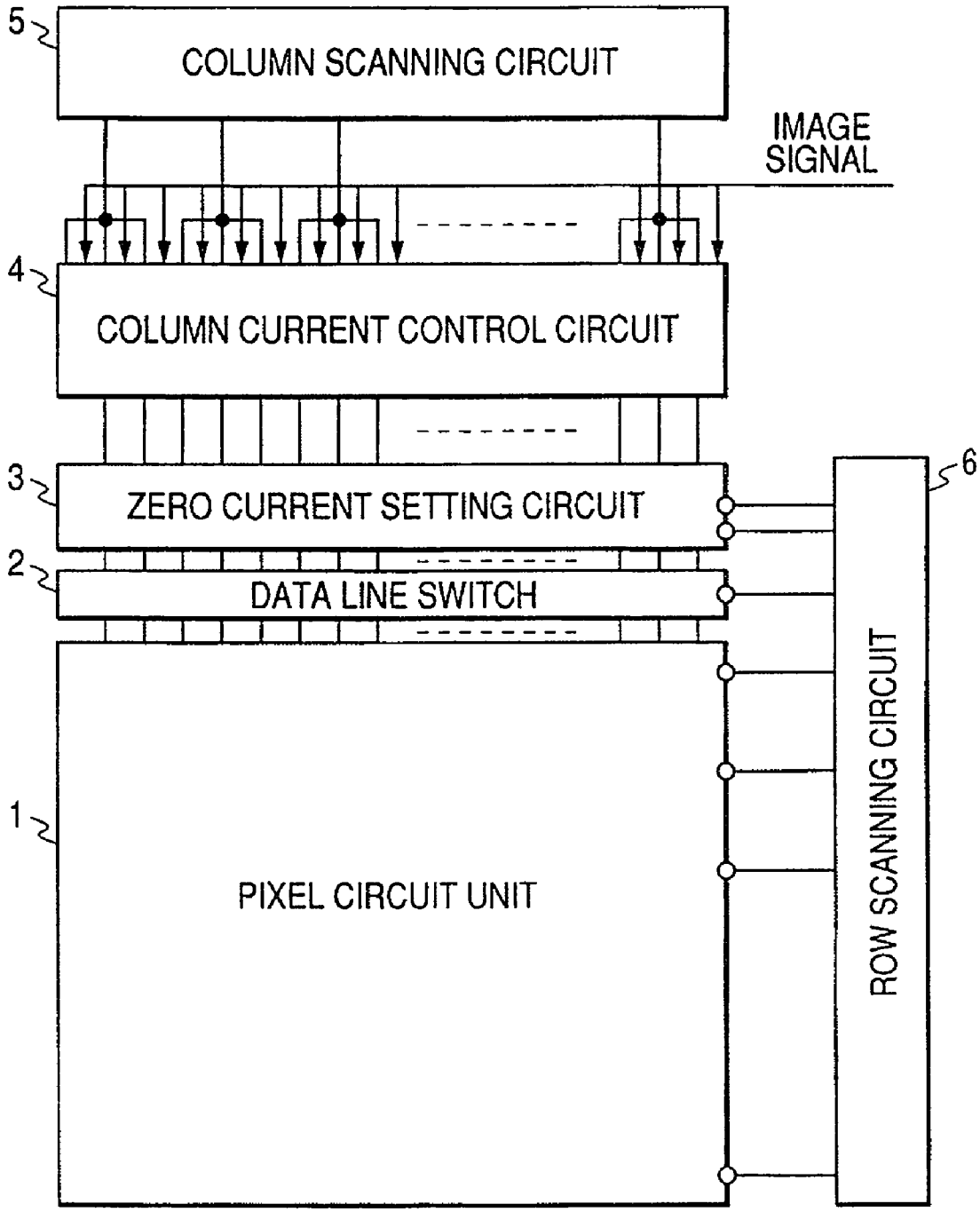
FIG. 3 is a configuration diagram showing the configuration of an active matrix field emission display apparatus according to the present invention.

FIG. 3 is a configuration diagram showing the configuration of an active matrix field emission display apparatus according to the present invention.

In FIG. 3, a reference numeral 1 denotes a pixel circuit unit composed of pixel circuits arranged in a matrix. In the pixel circuit unit 1, electroluminescent elements and circuits driving the electroluminescent elements are arranged in a matrix, and the pixel circuit unit 1 includes scanning signal lines connecting them in row directions and data lines connecting them in column directions.

A reference numeral 2 denotes data line switches performing the separation and the connection of the data lines. A reference numeral 3 denotes a zero current setting circuit provided to each pixel circuit column into which a current is written based on a zero setting current (a reference current). A reference numeral 4 denotes column current control circuits supplying line-sequential data line current signals Idata and zero setting currents to the data lines connected with pixel circuit groups arranged in the column directions. A reference numeral 5 denotes a column scanning circuit connected to the column current control circuits 4 for supplying the line-sequential data line current signals Idata to the data lines.

The column current control circuits 4 are variable current sources. The column current control circuits 4 generate currents based on data, and supply the generated currents to the plurality of pixel circuits in the column directions, which are connected to the column current control circuits 4 with the data lines. The column current control circuits further generate zero setting currents independent of data, and supply the generated zero setting currents to the zero current setting circuits 3.

The column scanning circuit 5 samples three image signals of R, G and B input into the column current control circuits 4 to each column.

A reference numeral 6 denotes a row scanning circuit connected to the pixel circuits arranged in the row directions, and sequentially outputs line scanning signals P1*m* and P2*m* to each line (a letter m denotes an integer of (1-M) on the supposition that there are M row scanning signal lines). Because each pixel circuit includes two row selection signal lines in the examples of the pixel circuits shown in the following embodiments, it is supposed that two row scanning signals also exist here. However, there can be cases where each pixel circuit includes one, three or the like of row selection lines in addition to the case of two row selection lines.

Figure 1:
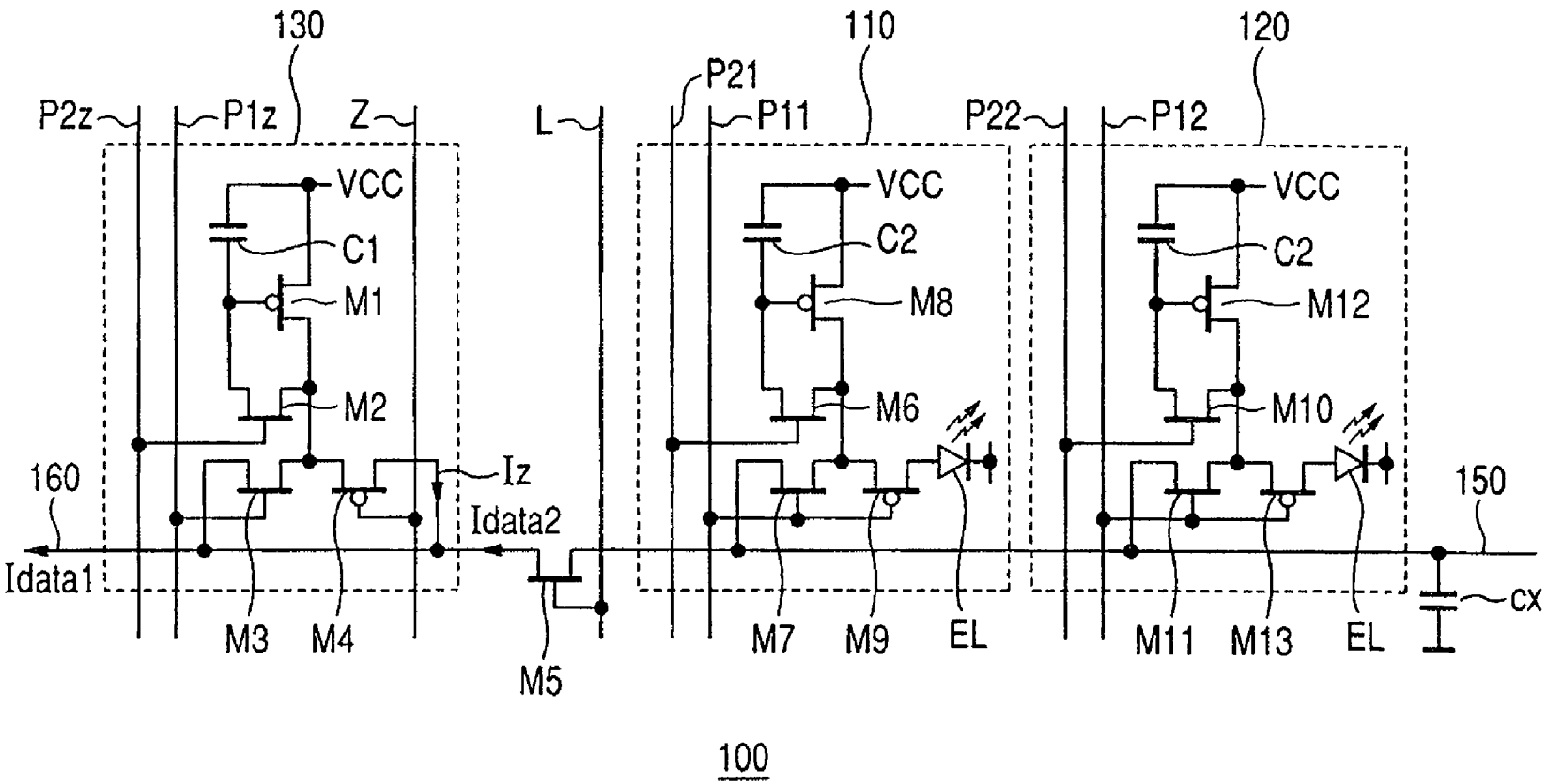
FIG. 1 is a diagram showing an example of the configuration of pixel circuits and a zero current setting circuit according to a first embodiment of the present invention.

FIG. 1 shows a current programming circuit according to a first embodiment of the present invention. The current programming circuit 100 of the present embodiment includes a first row pixel circuit 110, a second row pixel circuit 120 (although pixel circuits are continuously arranged in a third row, a fourth row and so forth after the second row pixel circuit 120, the illustration of them is omitted in FIG. 1), and a zero current setting circuit 130. Although only a part of the current programming circuit 100 connected to one data line is shown in FIG. 1, it is needless to stay that the matrix display apparatus of FIG. 3 includes a plurality of data lines and the same current programming circuit is provided to each data line.

Figure 2:
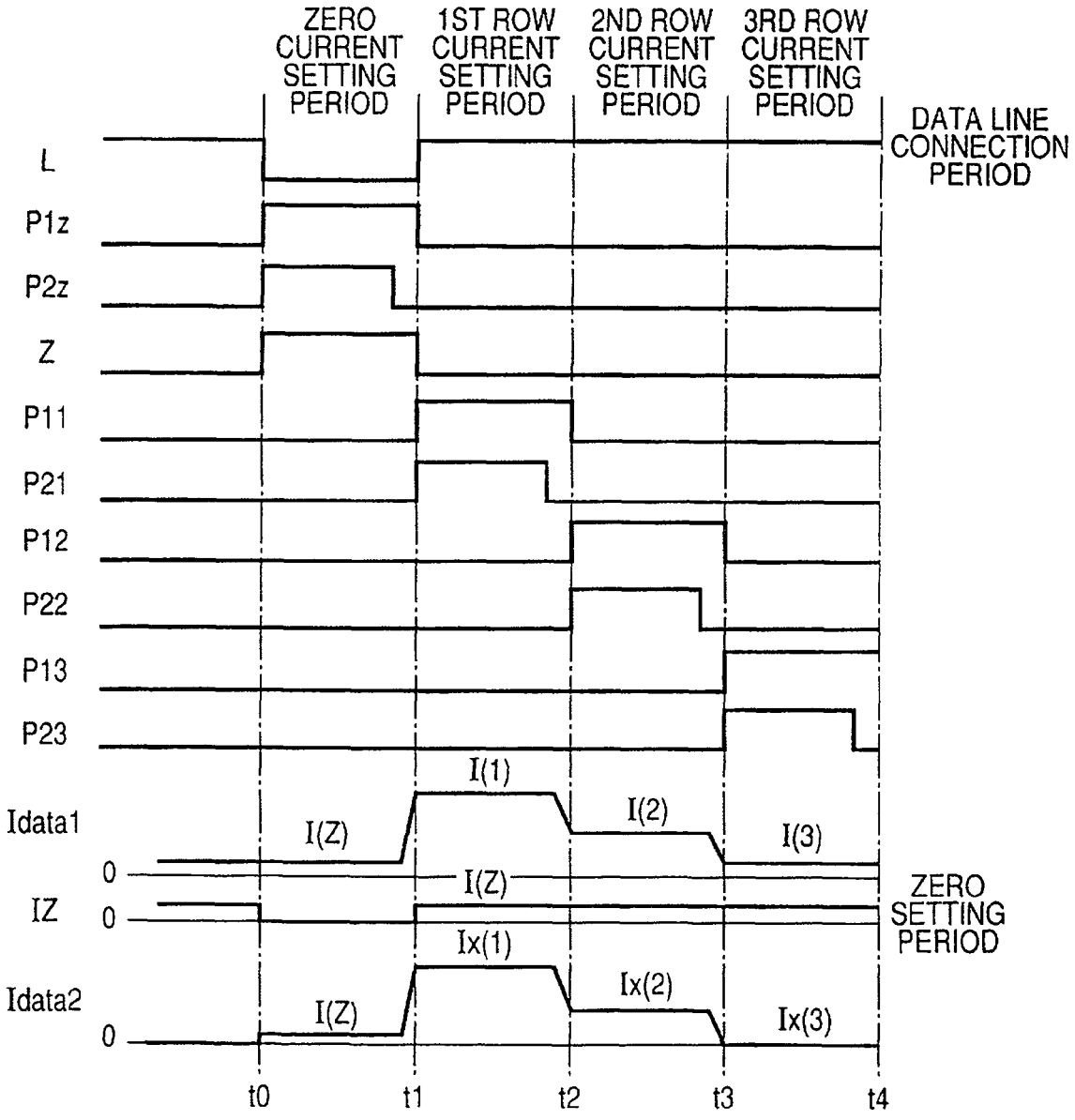
FIG. 2 is a timing chart for illustrating the operation of the pixel circuits and the zero current setting circuit according to the first embodiment of the present invention.

FIG. 2 is a timing chart for illustrating the operation of the circuit of FIG. 1. The ordinate axes of FIG. 2 indicate the voltage values of each signal, and the abscissa axes of FIG. 2 indicate times. The signal input into each of signal lines L, P1*z*, P2*z*, . . . of FIG. 1 is denoted by the same marks as those in FIG. 1.

In the present specification, a data line 150 indicates only a part to which the pixel circuits 110, 120, . . . are commonly connected, and the data line 150 is distinguished from wiring 160 on a current source side from a switch M5.

A reference mark Idata1 in FIG. 2 denotes a current flowing through the wiring 160 connected to the column current control circuits 4, not shown in FIG. 1, on the left side from a supply port of a current Iz generated by the zero current setting circuit 130. The reference mark Iz denotes the output current of the zero current setting circuit 130, and a reference mark Idata2 denotes a current flowing through a part nearest to the switch M5 of the data line.

Figure 4:
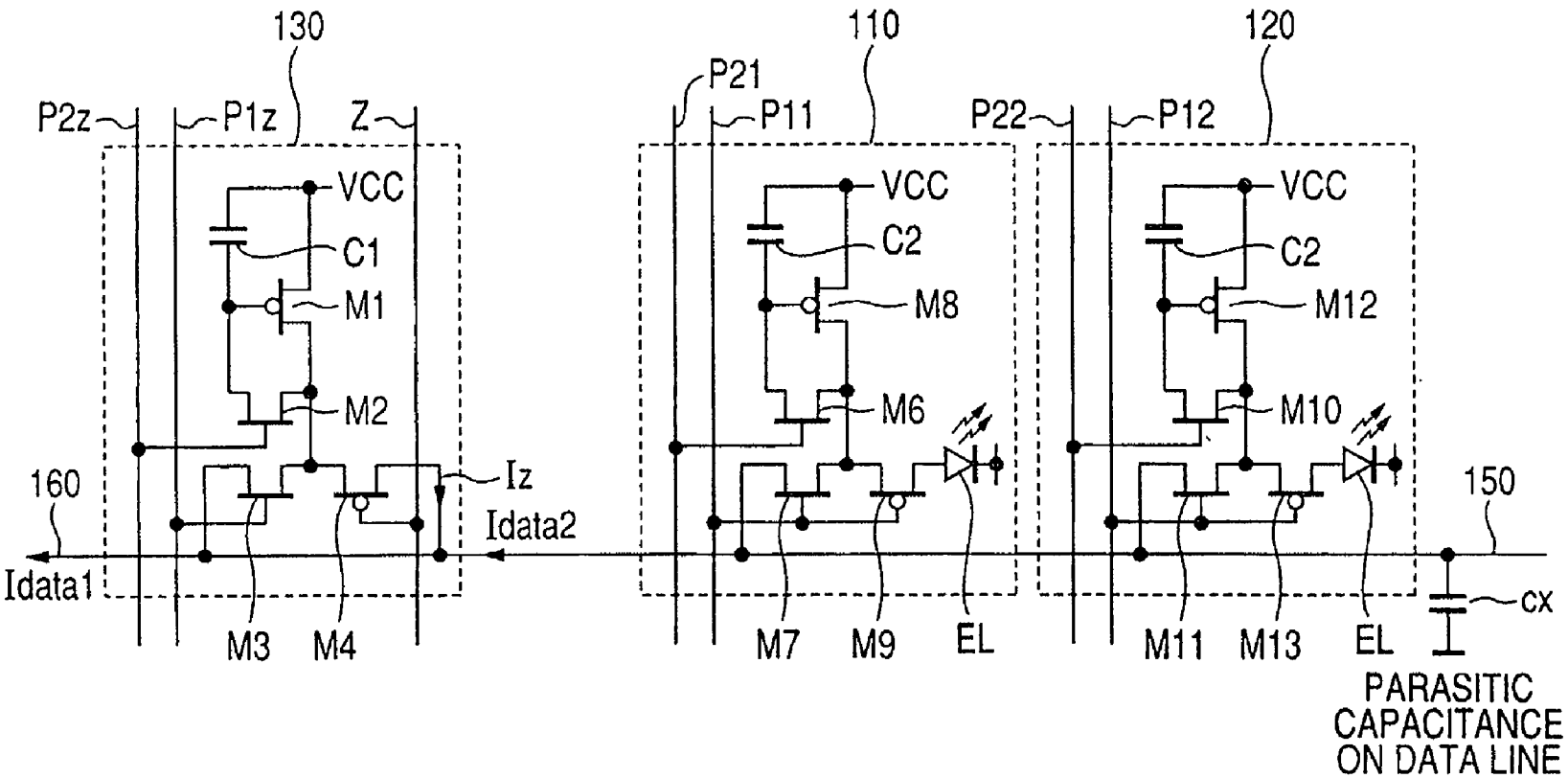
FIG. 4 is a diagram showing the configurations of pixel circuits and a zero current setting circuit of a comparison example.

FIG. 4 is a diagram showing the configuration of a current programming circuit as a comparison example.

Although the configurations of the pixel circuits 110 and 120 and the zero current setting circuit 130 of the comparison example shown in FIG. 4 are the same as those shown in FIG. 1, the configuration of the comparison example does not include the data line switch M5 between the zero current setting circuit 130 and the first row pixel circuit 110. The configuration of the comparison example differs from that shown in FIG. 1 in that the data line 150 portion, to which each of the pixel circuits 110, 120, . . . are connected, is continuous to the wiring 160 portion of the zero current setting circuit 130.

First, for making it easy to understand, the configuration and the operation of the comparison example, which is not provided with the data line switch M5, is described using FIGS. 2 and 4.

Now, the operation of the first row pixel circuit connected to a certain data line is considered. When the row scanning signal P11 becomes a high level in FIG. 2, an nMOS transistor M7 used as a switch for a first program (row selection) is turned on, and a pMOS transistor M9 as a switch for light emission selection turns off. Moreover, when the row scanning signal P21 becomes the high level, an nMOS transistor M6 used as a switch for a second program turns on.

As a result, the image data current Idata2 flowing through the data line is led to the gate and the drain of a pMOS transistor M8 used as a drive transistor, and charges a capacity C2 connected between the gate and the source.

The voltage of the capacity C2 connected to the gate of a pMOS transistor M8 used as a switch for drive is set as a gate-source voltage sufficient for the current driving the electroluminescent element (field luminescent element) EL based on the image data current flowing through the data line to flow through the pMOS transistor M8. Next, when the row scanning signal P21 becomes a low level, the nMOS transistor M6 used as the switch for the second program turns off, and the voltage of the capacity C2 is held. The period until now is a first row current setting period (drive current programming period).

After that, when the row scanning signal P11 becomes the low level, the nMOS transistor M7 used as the switch for the first program (row selection) turns off, and the pMOS transistor M9 used as the switch for the light emission selection turns on. The supply of a drive current to the electroluminescent element EL is controlled by the gate potential of the transistor M8 for drive, and the current flowing through the electroluminescent element EL is controlled. A period during which the electroluminescent element EL is emitting light (is not emitting light in case of a black display) is a light emitting period. Moreover, when the first row current setting period ends, a second row current setting period begins, and a drive current is sequentially written in the current setting period of each row based on an image data signal.

By the way, although it is preferable that the current of a line-sequential data line current signal is zero in the minimum luminance (black) display, it is actually difficult to make the current zero owing to the circuit configuration. Even if the image data input into one of the column current control circuits 4 of FIG. 3 is made to a black display signal, that is even if the signal voltage is made to the black display voltage level, the output current of the column current control circuit 4 does not become zero completely, and a little current (called as a zero current) flows through the connected wiring 160. If the current of the line-sequential data line current signal does not become zero, it is impossible to make the drive current of the electroluminescent element EL zero, and the setting of the black display cannot be performed sufficiently. Moreover, because the zero current is different at each data line owing to the dispersion of the column current control circuits 4, it is difficult to perform the subtraction of the zero current uniformly.

The inventors of the present application have paid attention to the problem previously, and proposed a method of providing the zero current setting circuits for performing the setting of the black display correctly (Japanese Patent Application Laid-Open No. 2004-312015). This patent application proposed a current programming circuit 100 including a zero setting circuit 130 as shown in FIG. 4. A zero current is programmed in the zero current setting circuit 130 in a predetermined period (the period is called as a zero current setting period) in a vertical blanking period. In a current programming period of the pixel circuits 110, 120, etc., a current is supplied from the zero current setting circuit into the data line in the direction of cancelling the current from column current circuits.

During the zero current setting period, the image data inputted into one of the column current control circuits 4 of FIG. 3 is made to a black display signal. That is, the signal voltage is made to be the black display voltage level.

As stated above, the output current of the column current control circuit 4 does not completely become zero, but a zero current flows through the connected wiring 160. Here, the control signals P1*z* and P2*z* are made to be the high level to turn nMOS transistors M3 and M2 on, respectively, the zero current flow into the zero current setting circuit 130 and the voltage across a capacity C1 connected to the gate of a pMOS transistor M1 is set as a level correlated to the zero current. When the control signals P1*z* and P2*z* become the low level, the voltage of the capacity C1 is held.

In the scanning period, a current Iz which is determined by the voltage across the capacity C1 flows through the pMOS transistors M1 and M4. The current flows into the data line, where a data current Idata1 has been supplied from column current circuit. Since the current Iz on the data line cancels a part of the data current Idata1, current Idata2 to be supplied to pixel circuits satisfies the formula of Idata2=Idata1−Iz.

Consequently, as the zero current is canceled, it becomes possible to set the current to flow in the pixel circuits completely zero at the time of a black display. Thus, by providing the zero current setting circuits, it becomes possible to set the true black displays.

However, the inventors of the present application have found that, even if the setting of the current is tried to be performed by the zero current setting circuits, it is difficult to stably perform the zero current setting owing to the influences of parasitic capacitance Cx of the data lines. Hereafter, the problem is described.

In FIG. 1, the parasitic capacitance Cx of a data line is shown. The capacity Cx results from wiring capacity, the capacity between the gate and the source of the transistor of the pixel circuits connected to a data line, and the like. Because the zero setting current is a minute current, it is not always easy to write a current based on the zero setting current during a limited vertical blanking period even if the current is tried to be set with the zero current setting circuit when the influences of the parasitic capacitance of the data line are exerted.

For example, it is supposed that pixel circuits from the first to the nth rows are connected to a certain data line, and that the voltage across the capacity C2 of the nth pixel circuit is set to be high for setting the nth pixel circuit to be high luminance. Then, the potential of the data line, or the voltage across the parasitic capacitance Cx, becomes low. In the zero current setting period in the next frame, it becomes difficult to fully raise the potential of the capacity C1 of the zero current setting circuit. This is because the zero current setting is the minute current writing operation and the zero current setting period is finite.

Furthermore, the potential of the data line is high in the case where the nth pixel has been black display and the potential of the data line is low in the case where the nth pixel has been high luminance. A difference is caused between the potentials of the data line in these two cases, which makes performing the zero current setting unstable.

In order to solve the problem, as shown in FIG. 1, the inventors of the present application have devised to provide the switch M5 of an nMOS transistor between the data line 150 and the current output terminal of the zero current setting circuit 130, and to turn the switch M5 on and off with the control signal on the signal line L. Then, the inventors have devised to turn off the switch M5 during the zero current setting period for separating the data line and the pixel circuits 110, 120, . . . from the zero current setting circuit 130. Thereby, the zero current is separated from the parasitic capacity of the data line during the zero current setting period to make it possible to write the zero current into the zero current setting circuit correctly. Moreover, because the zero current is not influenced by the parasitic capacitance, the writing of the zero setting current can be performed more quickly.

Although the capacity C1 may be individually formed as a capacity element, the capacity C1 also may not be formed as an element, but the parasitic capacitance formed between the gate and the source (the capacity of the overlapping of the gate electrode and the source region, or the like) may be used as capacity C1.

Second Embodiment

Figure 5:
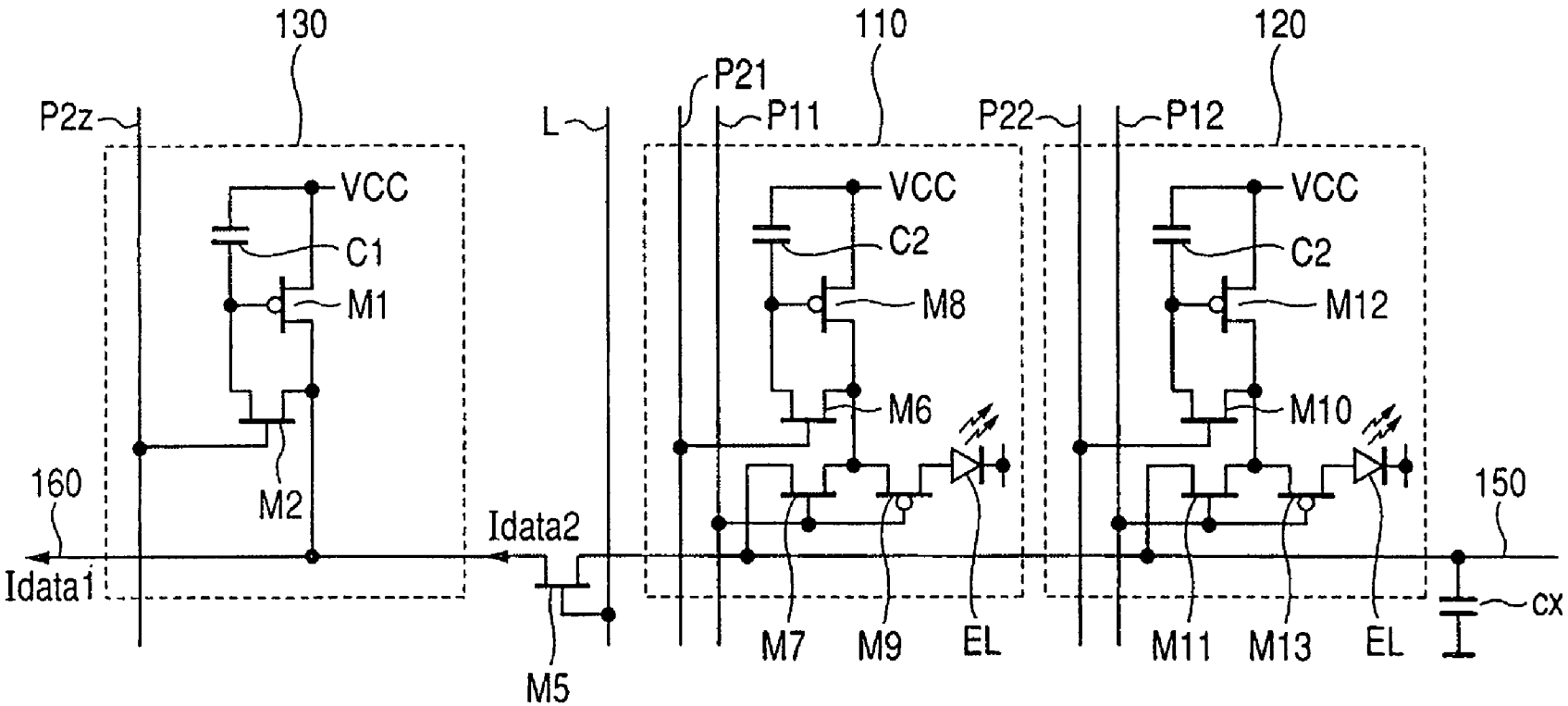
FIG. 5 is a diagram showing an example of the configuration of pixel circuits and a zero current setting circuit according to a second embodiment of the present invention.

FIG. 5 is a diagram showing an example of the configuration of the current programming circuit according to a second embodiment of the present invention. In the present embodiment, the configuration of the zero current setting circuit 130 is more simplified by omitting the nMOS transistor M3 and the pMOS transistor M4, and by connecting the PMOS transistor M1 to the data line directly. In such a configuration, also the effect similar to that of the first embodiment also can be acquired.

Although the active matrix type display apparatus using the current based driven display elements is picked up to be described as an example of using the current programming apparatus according to the present invention above, the current programming apparatus according to the present invention can be applied to a use, as long as the use is that using a current setting circuit holding a current to be flown into a data line as the gate-source voltage of a transistor. The use of the current programming apparatus according to the present invention is not limited to the active matrix type display apparatus using the current based driven display elements such as electroluminescent elements and electron emitting elements, but the current programming apparatus according to the present invention is used as a circuit for current programming such as an analog memory. In case of using the current programming apparatus as the analog memory, the current programming apparatus adopts a configuration in which the electroluminescent element EL is removed from each of the pixel circuits, and analog value is taken out from the circuit as a current value. Moreover, the application of the present invention is not restricted to the matrix-like display apparatus, but the present application can be applied also to a line-like display apparatus.

The present invention is used for an active matrix type display apparatus of a current based driven type light emitting devices such as the electroluminescent elements (EL elements) and other electro-optic elements, and also used for an analog memory.

This application claims priority from Japanese Patent Application No. 2004-342129 filed Nov. 26, 2004, which is hereby incorporated by reference herein.

What is claimed is:

1. A matrix type display apparatus, comprising:

a pixel circuit unit including electroluminescent elements and pixel circuits, driving the electroluminescent elements arranged in a matrix;

a plurality of data lines, each corresponding to a column of the pixel circuits, for supplying a data current to the pixel circuits;

predetermined current setting circuits for supplying to the data lines a predetermined current for reducing a current to be supplied to the data lines, according to a setting by a reference current unrelated to a displaying, at a time of black displaying of the electroluminescent elements;

switches, corresponding to each of the data lines, arranged between the pixel circuit unit and the predetermined current setting circuits, and a row scanning circuit for controlling on and off of the switches, wherein the row scanning circuit turns off the switches to disconnect the pixel circuit unit and the predetermined current setting circuits, and sets the predetermined current in the predetermined current setting circuits, and thereafter, the row scanning circuit turns on the switches to connect the pixel circuit unit and the predetermined current setting circuits, and to supply the data lines with the data currents and the predetermined current, wherein the switches are separate from the pixel circuit unit.

2. A matrix type display apparatus according to claim 1, wherein the predetermined currents are currents generated by said current source when said display elements are displayed at their minimum luminance.

3. A matrix type display apparatus according to claim 1, wherein said display elements are electroluminescence elements.

* * * * *